US006353355B2

(12) United States Patent
Kato

(10) Patent No.: US 6,353,355 B2
(45) Date of Patent: Mar. 5, 2002

(54) SEMICONDUCTOR DEVICE ENABLING HIGH-SPEED GENERATION OF INTERNAL POWER-SUPPLY POTENTIAL AT THE TIME OF POWER ON

(75) Inventor: Hiroshi Kato, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/755,038

(22) Filed: Jan. 8, 2001

(30) Foreign Application Priority Data

Jul. 4, 2000 (JP) ..... 2000-202458

(51) Int. Cl.[7] ..... G05F 1/10
(52) U.S. Cl. ..... 327/535; 327/143
(58) Field of Search ..... 327/72, 73, 77, 327/142, 143, 198, 530, 534, 535, 537, 538, 540, 541, 543, 545, 546

(56) References Cited

U.S. PATENT DOCUMENTS 5,909,141 A * 6/1999 Tomishima ..... 327/536
5,936,443 A 8/1999 Yasuda et al. ..... 327/143
6,218,893 B1 * 4/2001 Noguchi ..... 327/540

FOREIGN PATENT DOCUMENTS

| | | |
|---|---|---|
| JP | 2-293916 | 12/1990 |
| JP | 5-22100 | 1/1993 |
| JP | 9-153777 | 6/1997 |

* cited by examiner

*Primary Examiner*—Jeffrey Zweizig
(74) *Attorney, Agent, or Firm*—McDermott, Will & Emery

(57) ABSTRACT

A voltage generating circuit includes a primary reference potential signal generating circuit and a reference potential signal generating circuit, respectively generating a primary reference potential signal and a reference potential signal, and further includes an active VDC controlling a potential level of an internal power-supply potential Vcc1 based on the reference potential signal. First and second activation control circuits respectively activate control signals ALV1 and ALV2, for rapidly operating the voltage generating circuit, for a period from an activation of an external power-supply until the primary reference potential signal and the reference potential signal reach a predetermined value. The first and second activation control circuits detect the activation of the external power-supply, without the primary reference potential signal and the reference potential signal.

20 Claims, 14 Drawing Sheets

SEMICONDUCTOR DEVICE ENABLING HIGH-SPEED GENERATION OF INTERNAL POWER-SUPPLY POTENTIAL AT THE TIME OF POWER ON

BACKGROUND OF THE INVENTION

1. Field of the Invention

The present invention relates to a semiconductor device, and in particular to a semiconductor device that incorporates a voltage generating circuit, converting an external power-supply potential supplied from an external power-supply into an internal power-supply potential which is to be used for driving an internal circuit.

2. Description of the Background Art

In a device including a group of internal circuits driven at various potential levels, such as a semiconductor device, a voltage generating circuit is used, for converting an external power-supply potential supplied from an external power-supply into an internal power-supply potential of a desired potential level. Such a voltage generating circuit includes a socalled VDC (Voltage Down Converter) or the like.

FIG. 14 is a schematic block diagram showing a configuration of a voltage generating circuit 500 commonly used for generation of an internal power potential within a semiconductor device.

Referring to FIG. 14, voltage generating circuit 500 includes a VREF generating circuit 510 receiving an external power-supply potential VDD from an external power-supply line 505 to generate a reference potential signal VREF corresponding to a set value of the internal power-supply potential, and a VDC 520 generating an internal power-supply potential Vcc to an internal power-supply line 525.

VDC 520 compares a potential level of internal power-supply line 525 to that of reference potential signal VREF, and if the potential level of internal power-supply line 525 is lower than that of reference potential signal VREF, VDC 520 supplies current from external power-supply line 505 to internal power-supply line 525 in an attempt to hold internal power-supply potential Vcc at a target level.

Therefore, when an external power-supply is turned on and external power-supply potential rises at external power-supply line 505, the potential level of reference potential signal VREF rises, and then internal power-supply potential Vcc is controlled by VDC 520 based on reference potential signal VREF.

Thus, in voltage generating circuit 500, when the external power-supply is turned on, the external power-supply potential, reference potential signal VREF and internal power-supply potential Vcc are activated in this order. Setting accuracy of internal power-supply potential Vcc, which is controlled by voltage generating circuit 500, is greatly affected by the setting accuracy of reference potential signal VREF, so that a configuration in which reference potential signal VREF is generated stepwise is also used, in order to avoid transient overshoot and so forth and to more stably generate internal power-supply potential Vcc.

However, in a semiconductor device, time period from activation of the external power-supply to actual operation of an internal circuit must satisfy a standard value defined by a specification. Thus, when the external power-supply is turned on (hereinafter also referred to as "at the time of power on"), at which transient variation in potential tends to occur, stable generation of reference potential signal VREF is required, while speed-up of rising of internal power-supply potential Vcc is also required.

Monitoring potential level of the internal power-supply line, if the potential level of internal power-supply potential Vcc is not higher than a predetermined value, an operational speed of VDC may possibly be increased to be higher than usual. However, at an initial state, i.e., at the time of power on, the potential level of each internal node is in a transient state. Therefore, there arises a problem that which internal node is to be compared, for its potential level, with internal power-supply potential Vcc, to switch the operational speed of VDC.

SUMMARY OF THE INVENTION

It is an object of the present invention to provide a configuration of a semiconductor device, in which an internal power-supply potential used in an internal circuit can be generated at a high speed at the time of power on.

It is another object of the present invention to provide a configuration of a semiconductor device, in which rising speed of an internal power-supply potential at the time of power on can be easily selected in a manufacturing process.

According to one aspect of the present invention, a semiconductor device, supplied, for operation, with a first external power-supply potential from a first external power-supply, includes an external power-supply line, a voltage generating circuit and an internal circuit. The external power-supply line transmits the first external power-supply potential. The voltage generating circuit converts the first external power-supply potential received from the external power-supply line into an internal power-supply potential to be supplied to an internal power-supply line. The internal circuit receives the internal power-supply potential from the internal power-supply line, for operation. The voltage generating circuit includes a reference potential generating unit receiving the first external power-supply potential from the external power-supply line to generate a reference potential signal in accordance with a set potential level of the internal power-supply potential at an intermediate node, a voltage converting circuit supplying current, in accordance with a difference between potential levels of the internal power-supply line and the first intermediate node, from the external power-supply line to the internal power-supply line, a first current supply circuit supplying a first operational current to the voltage converting circuit during an activation period of a first control signal, and a first activation control circuit activating the first control signal for the period from activation of the first external power-supply until the potential level of the internal power-supply line reaches a predetermined level. The first activation control circuit detects the activation of the first external power-supply by comparing potential level of a first reference node transmitting a first potential with that of the internal power-supply line. The first reference node is electrically separated from a node affecting a potential level of the reference potential signal.

According to another aspect of the present invention, a semiconductor device, supplied with a first external power-supply potential from a first external power-supply for operation, includes an external power-supply line, a plurality of voltage generating circuits and a plurality of internal circuits. The external power-supply line supplies the first external power-supply potential. The plurality of voltage generating circuits convert the first external power-supply potential received from the external power-supply line into a plurality of internal power-supply potentials respectively. The plurality of internal circuits respectively receive the plurality of internal power-supply potentials from the plurality of voltage generating circuits. Each of the voltage generating circuits includes an internal power-supply line outputting a corresponding one of the plurality of internal power-supply potentials, a reference potential generating unit receiving the first external power-supply potential from the external power-supply line, to generate a reference potential signal in accordance with a set potential level of the corresponding one of internal power-supply potentials, a voltage converting circuit supplying current in accordance with a difference between potential levels of the internal power-supply line and a first intermediate node from the external power-supply line to the internal power-supply line, a voltage converting circuit supplying current in accordance with a difference between potential levels of the internal power-supply line and the first intermediate node, and a first current-supply circuit supplying a first operational current to the voltage converting circuit in response to an activation of a first control signal. One of the plurality of voltage generating circuits includes a first activation control circuit activating the first control signal, for a period from activation of the first external power-supply until a potential level of the internal power-supply line corresponding to any one of the plurality of voltage generating circuits reaches a predetermined potential level. The first activation control circuit detects the activation of the first external power-supply by comparing a potential level of a first reference transmitting a first potential to that of the internal power-supply line corresponding to another one of the plurality of voltage generating circuits. The first reference node is electrically separated from a node affecting a potential level of the reference potential signal.

According to a further aspect of the present invention, a semiconductor device supplied with first and second external power-supply potentials respectively from first and second external power-supply, for operation, includes a first external power-supply line, a second external power-supply line, a voltage generating circuit, an internal circuit, and first, second and third metal interconnections. The first external power-supply line supplies the first external power-supply potential. The second external power-supply line supplies the second external power-supply potential. The voltage generating circuit converts the first external power-supply potential received from the first external power-supply line into an internal power-supply potential to be supplied to an internal power-supply line. The internal circuit receives the internal supply potential, for operation. The voltage generating circuit includes a reference potential generating unit receiving the first external power-supply potential from the first external power-supply line, for generating a reference potential signal in accordance with a set potential level of the internal power-supply potential at a first intermediate node, a voltage converting circuit supplying current in accordance with a difference between potential levels of the internal power-supply line and the first intermediate node, from the first external power-supply line to the internal power-supply line, a first current-supply circuit supplying a first operational current to the voltage converting circuit during an activation period of a first control signal, and a first activation control circuit activating the first control signal, for a period from activation of the first external power-supply until a potential level of the internal power-supply line reaches a predetermined level. The first activation control circuit detects the activation of the first external power-supply, by comparing a potential level of a first reference node to that of the internal power-supply line. The first, second and third metal interconnections are formed on a same metal interconnection layer and electrically coupled to the first reference node, the first intermediate node and the second external power-supply line, respectively. The first metal interconnection and one of the second and third metal interconnections are electrically coupled on the metal interconnection layer.

Therefore, a main advantage of the present invention is that, at the time of activation of the first external power-supply, rising speed of the internal power-supply potential can be increased by avoiding the temporary decrease of the potential level of the reference potential signal, caused by the operation of the first activation control circuit for rapidly charging the internal power-supply line generating the internal power-supply potential.

Moreover, in a semiconductor device generating a plurality of internal power-supply potentials, the first activation control circuit for rapidly charging the internal power-supply line at the time of activation of the external power-supply can be shared across a plurality of voltage generating circuits, so that circuit area can be reduced.

Furthermore, at the time of manufacturing semiconductor device, it is possible, by switching a metal mask for forming a metal interconnection layer, to select whether internal power-supply potential is generated based on a plurality of external power-supplies, giving priority to the rising speed, or based on a single external power-supply, giving priority to the operational stability.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 2 is a circuit diagram showing a configuration of a voltage generating circuit 600 activated when a power-supply is turned on;

DESCRIPTION OF THE PREFERRED EMBODIMENTS

Embodiments of the present invention will be described below with reference to the drawings.

First Embodiment

Figure 1:
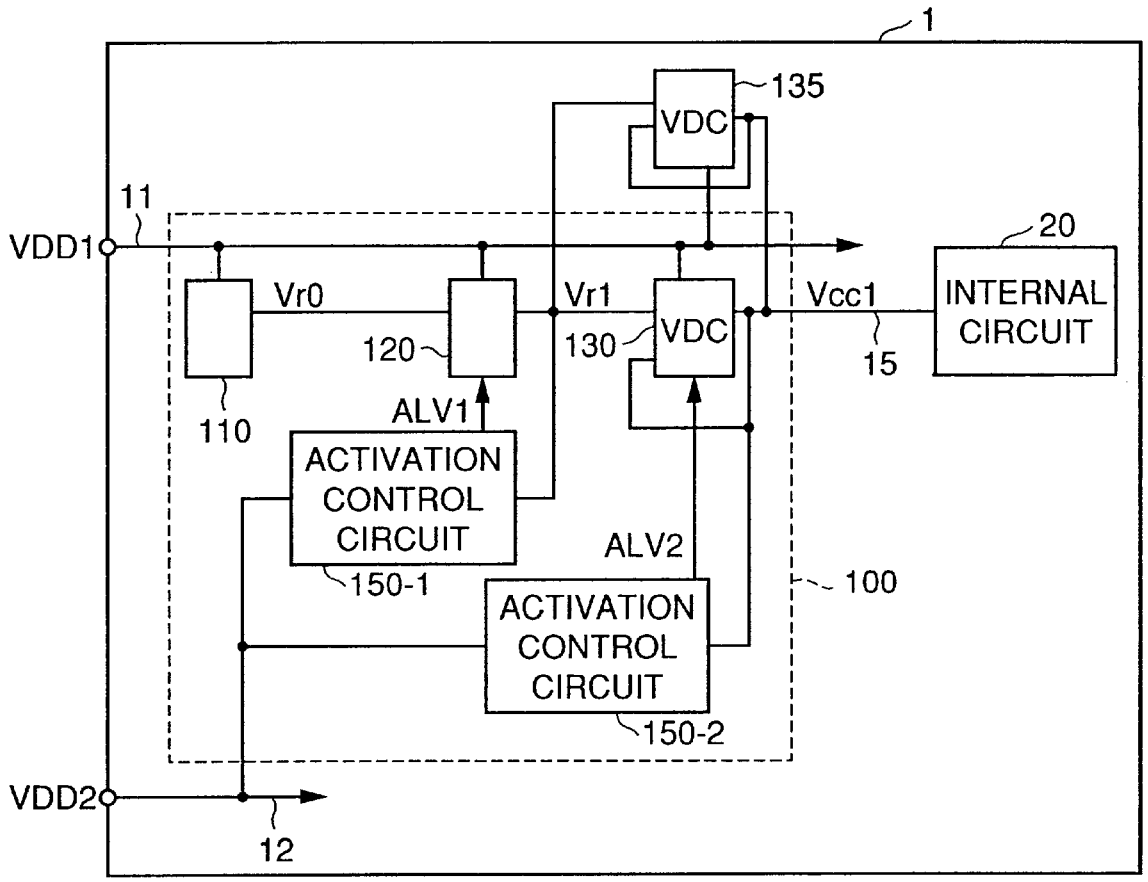
FIG. 1 is a schematic block diagram showing a configuration of a semiconductor device 1 according to the first embodiment of the present invention.

Referring to FIG. 1, a semiconductor device 1 according to the first embodiment of the present invention is driven by a plurality of external power-supply potentials such as VDD1 and VDD2. Semiconductor device 1 includes a voltage generating circuit 100 which receives an external power-supply potential VDD1 from an external power-supply line 11 and generates internal power-supply potential Vcc1 to an internal power-supply line 15.

Voltage generating circuit 100 includes a primary reference potential signal generating circuit 110, i.e., a circuit preceding to a reference potential generating circuit 120, receiving external power-supply potential VDD1 from external power-supply line 11 and outputting a primary reference potential signal Vr0; reference potential signal generating circuit 120 generating a reference potential signal Vr1 based on primary reference potential signal Vr0; and an active VDC 130 supplying current from external power-supply line 11 to the internal power-supply line in accordance with the difference between the potential levels of reference potential signal Vr1 and internal power-supply line 15. Thus, primary reference potential signal generating circuit 110 and reference potential signal generating circuit 120 generate reference potential signal Vr1 having a potential level equal to that of primary reference potential signal Vr0, to another node, and the generated reference potential signal Vr1 will be used as a direct reference potential for internal power-supply potential Vcc. A node N1 where reference potential signal Vr1 is generated could be a node on a long-distance line, which would make reference potential signal Vr1 susceptible to noise. However, no long-distance line node will be required at an output of primary reference potential signal Vr0, so that the signal Vr0 cannot be easily affected by noise. As described above, a configuration can be realized, in which noise is minimized for primary reference potential signal Vr0, which has an analog intermediate potential most susceptible to noise.

Voltage generating circuit 100 further includes activation control circuits 150-1 and 150-2 respectively generating control signals ALV1 and ALV2. Activation control circuit 150-1 sets control signal ALV1 to an activated state when the potential level of reference potential signal Vr1 is not more than a predetermined value at the time of power on, to temporarily increase the operational speed of reference potential signal generating circuit 110. Activation control circuit 150-2 activates active VDC 130 when the potential level of internal power-supply voltage Vcc1 is not more than a predetermined value at the time of power on, to increase rising speed of internal power-supply potential Vcc1.

Semiconductor device 1 further includes a stand-by VDC 135 arranged in parallel with active VDC 130. Stand-by VDC 135, as in the case with active VDC 130, supplies current from external power-supply line 11 to internal power-supply line 15, in accordance with the difference between the potential levels of reference potential signal Vr1 and internal power-supply line 15. Stand-by VDC 135 is arranged to compensate gradual variation at a stand-by of internal power-supply potential Vcc1, and has an operational speed slower than that of active VDC 130. Stand-by VDC 135 also has less consumption current compared to that of active VDC 130, and is basically kept active once the power-supply is turned on.

Semiconductor device 1 further includes an internal circuit 20 supplied with internal power-supply potential Vcc1 from internal power-supply line 15, for operation, and an external power-supply line 12 for supplying external power-supply potential VDD2.

Though a power-supply system in which external power-supply potential VDD1 is converted into internal power-supply potential Vcc1 is represented in a semiconductor device in FIG. 1, application of the present invention is not limited to the case where single power-supply system is employed. That is, for a semiconductor device including a plurality of such power-supply systems therein, the present invention can also be applied for each power-supply system.

[General Configuration of Voltage Generating Circuit Activated at the Time of Power On]

Prior to describing a configuration of voltage generating circuit 100 according to the first embodiment, a problem caused when the power-supply is turned on is described using a voltage generating circuit 600 having a configuration similar to voltage generating circuit 100.

Figure 2:
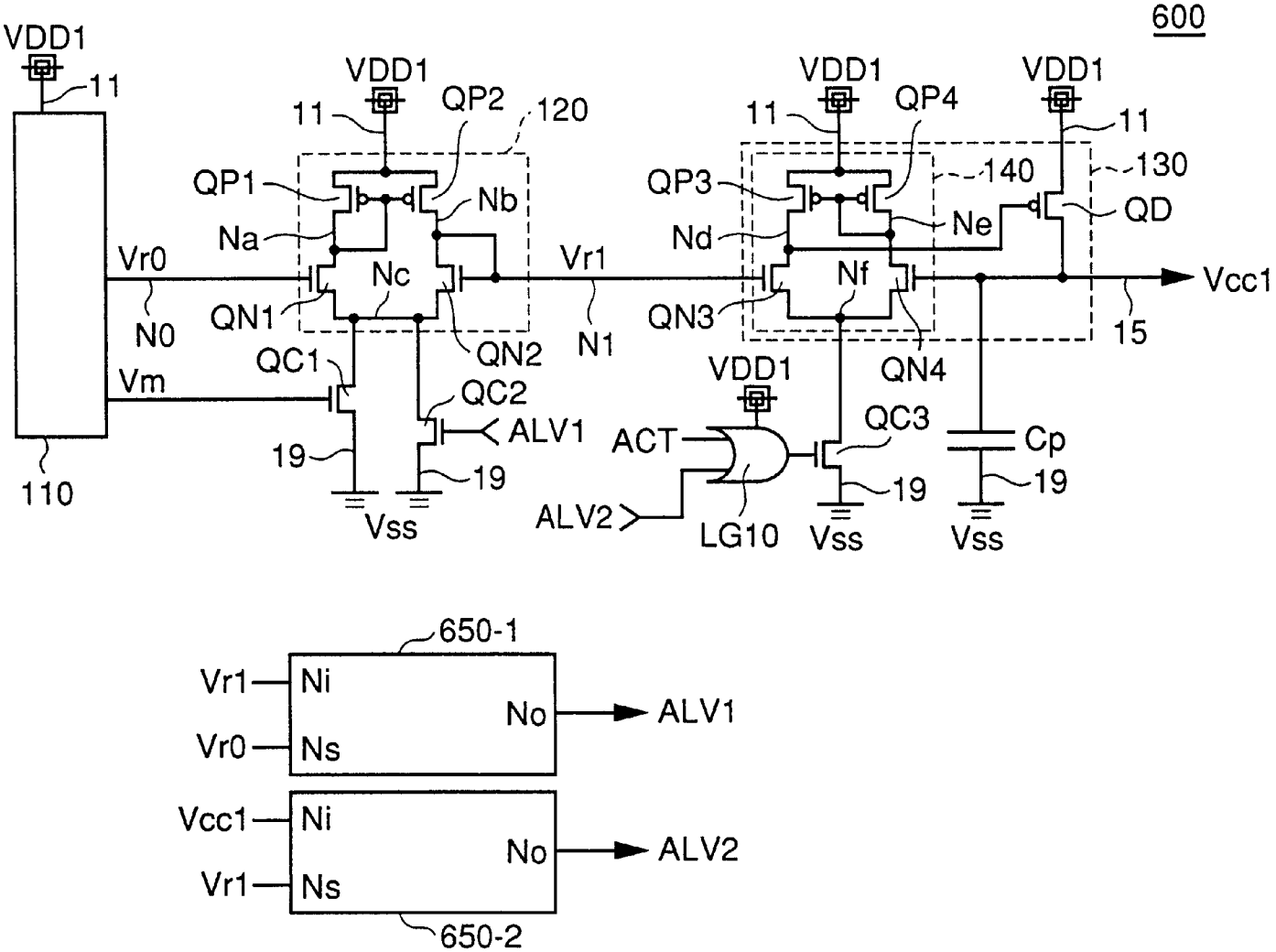

Referring to FIG. 2, voltage generating circuit 600, activated at the time of power on, includes a primary reference potential signal generating circuit 110 receiving external power-supply potential VDD 1 from external power-supply line 11 and outputting a primary reference potential signal Vr0 to a node N0, a reference potential generating circuit 120 generating a reference potential signal Vr1 to a node N1 based on primary reference potential signal Vr0, and a differential amplifying circuit 140 and a current driving transistor QD constituting active VDC 130. Differential amplifying circuit 140 amplifies the difference between the potential levels of node N1 and internal power-supply line 15 to output the amplified result. Current driving transistor QD supplies an amount of current corresponding to the output of differential amplifying circuit 140, from external power-supply line 11 to internal power-supply line 15. Capacitance added to internal power-supply line 11 is denoted as Cp. Internal power-supply line 15 transmits internal power-supply potential Vcc to internal circuit 20.

Voltage generating circuit 600 further includes N-type MOS transistors QC1 and QC2 for supplying operational current to reference potential signal generating circuit 120, an N-type transistor QC3 for supplying operational current to differential amplifying circuit 140, and a logic gate LG10 applying a control signal to the gate of transistor QC3. In the embodiments of the present invention, an MOS transistor is used as a representative example of a field effect transistor.

Primary reference potential signal generating circuit 110 generates a predetermined primary reference potential signal Vr0 in response to the activation of external power-supply potential VDD1.

Figure 3:
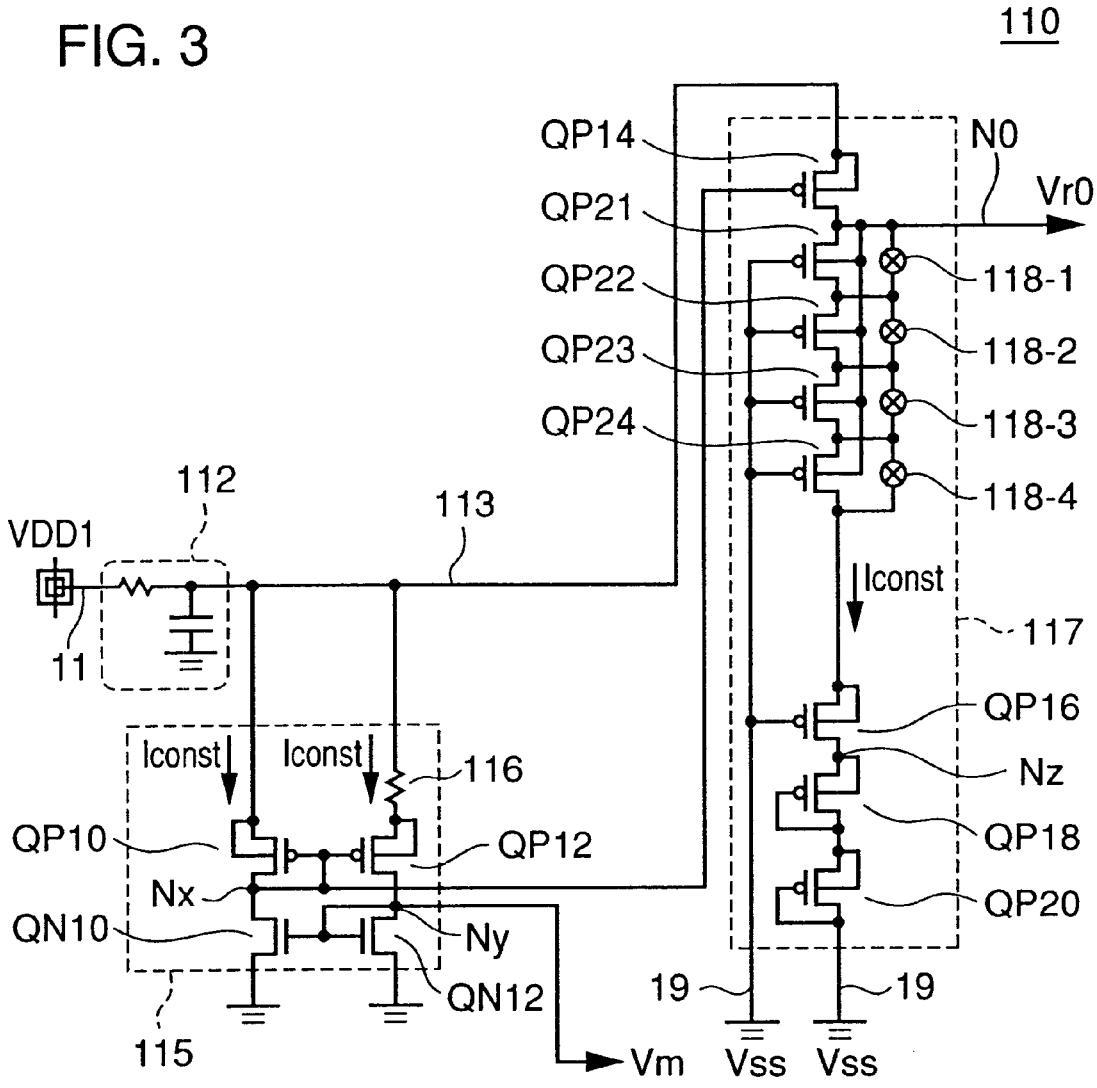
FIG. 3 is a circuit diagram showing a configuration of a primary potential signal generating circuit 110.

FIG. 3 is a circuit diagram showing a configuration of primary reference potential signal generating circuit 110.

Referring to FIG. 3, primary reference potential signal generating circuit 110 includes a low-pass filter 112, a constant current generating unit 115, and a primary reference potential adjusting unit 117.

Low-pass filter 112 removes high-frequency noise from external power-supply potential VDD1 and transmits the resulted VDD1 to a line 113. Constant current generating unit 115 includes P-type MOS transistors QP10 and QP12, N-type MOS transistors QN10 and QN12, and a resistance element 116. N-type MOS transistors QN10 and QN12 are designed to have the same size, whereas transistors QP10 and QP12 are designed to have different sizes. This makes, in constant current generating unit 115, the current flowing through transistors QP10, QN10 and the current flowing through transistors QP11, QN11 constant current $I_{const}$, which reflects the characteristic difference of transistors QP10 and QP12 in a sub-threshold region, and is independent of variation in the potential level of line 113. An intermediate potential Vm, generated at a node Ny corresponding to current $I_{const}$ is input to the gate of a transistor QC1 shown in FIG. 2.

A primary reference potential adjusting unit 117 includes a P-type MOS transistor QP14 electrically coupled between line 113 and node N0 generating primary reference potential Vr0, P-type MOS transistors QP16, QP21-QP24, connected in series between nodes N0 and Nz, fuse elements 118-1 to 118-4 respectively coupled in parallel with transistors QP21 to QP24, and P-type MOS transistors QP18 and QP20 connected in series between node Nz and a ground line 19.

Transistor QP14 is designed to have the same size as that of transistor QP12, such that current flowing in primary reference potential adjusting unit 117 will be equal to constant current $I_{const}$ in a constant current generating circuit 115.

The gates of transistors QP16, QP21–QP24 are coupled to ground line 19, to serve as equivalents of resistance elements. A potential corresponding to the sum of threshold voltages of transistors QP18 and QP20 is generated at node Nz. Therefore, the level of the potential of node N0, i.e., primary reference potential Vr0, is determined in accordance with the potential of node Nz and a voltage drop caused between nodes N0 and Nz by constant current $I_{const}$, so that the potential level of primary reference potential Vr0 can be maintained constant, even if external power-supply potential VDD1 varies.

The voltage drop between nodes N0 and Nz can be adjusted by the number of fuse elements to be blown, so that fine adjustment to the potential level of primary reference potential signal Vr0 is also possible. The number of transistor pairs serving as fuse elements and resistance elements that are used for adjustment can be any arbitrary plural number, not limited to the example in FIG. 3.

Referring again to FIG. 2, transistor QC1 supplies normal operational current to reference potential signal generating circuit 120. If the threshold voltage of transistor QC1 is made approximately the same as that of transistors QN10 and QN12 shown in FIG. 3, the operational current of reference potential generating circuit 120 can be suppressed to the level of $I_{const}$ shown in FIG. 3.

Therefore, the potential level of a direct potential signal Vm is set to a level somewhat higher than the threshold voltage of transistor QC1, for reducing the operational current.

In order for reference potential signal VREF to rise at a high speed at the time of power on, transistor QC2 supplies large operational current for rapidly operating reference potential signal generating circuit 120 during an activation period bevel H) of control signal ALV1.

Reference potential generating circuit 120 includes P-type MOS transistors QP1 and QP2 electrically coupled between external power-supply line 11 and nodes Na, Nb respectively, and N-type MOS transistors QN1 and QN2 electrically coupled between nodes Na, Nb and node Nc respectively. The gates of transistors QP1 and QP2 are coupled to node Na. Node Nb is coupled to node N1 where reference potential signal Vr1 is generated, hence, to the gate of transistor QN2.

Such a configuration allows reference potential signal generating circuit 120 to be supplied with the operational current from transistor QC1 only, or from both transistors QC1 and QC2, and to charge node N1 in accordance with the difference between potential levels of nodes N0 and N1. This enables reference potential signal Vr1 to be generated at node N1, based on primary reference potential signal Vr0 generated at node N0. In the configuration shown in FIG. 2, the potential levels of primary reference potential signal Vr0 and reference potential signal Vr1 are equal to each other, so that the relation therebetween will be Vr0=Vr1.

Differential amplifying circuit 140 includes P-type MOS transistors QP3 and QP4 electrically coupled between external power-supply line 11 and nodes Nd and Ne respectively, and N-type MOS transistors QN3 and QN4 electrically coupled between nodes Nd, Ne and node Nf respectively. Differential amplifying circuit 140 includes a so-called current mirror amplifier configuration, and amplifies the difference between potential levels of node N1 and internal power-supply line 15 to output the amplified result to node Nd. Node Nd is coupled to the gate of current driving transistor QD. Differential amplifying circuit 140 is supplied with operational current from transistor QC3. The output of logic gate LG10 is input to the gate of transistor QC3. Logic gate LG10 receives control signals ACT and ALV2, and outputs the results of OR logic operations for both signals. During activation (level H) period of the output signal of logic gate LG10, active VDC 130 is activated.

At the time of power on, control signals ALV1 and ALV2 are set to the activated state (level H) in order to operate voltage generating circuit 600 at a high speed, for internal power-supply voltage Vcc1 to rise rapidly. After internal power-supply potential Vcc1 rises to the set level, control signal ACT is activated (level H), in response to occurrence of an event, such as activation of a sense amplifier in a semiconductor device, which consumes relatively large current.

Stand-by VDC 135 shown in FIG. 1 has a configuration similar to active VDC 130, and receives small current from a current-supply transistor similar to transistor QC2, for operating. Further, in place of stand-by VDC 135, a new transistor may be arranged in parallel with transistor QC3, supplying small current to active VDC 130 for the activation period of stand-by VDC 135.

Voltage generating circuit 600 further includes activation control circuits 650-1 and 650-2, respectively generating control signals ALV1 and ALV2. Each of activation control circuits 650-1 and 650-2 includes an input node Ni, a reference node Ns and an output node No generating a control signal.

Activation control circuit 650-1 sets control signal ALV1 generated at output node No to the activated state, if the potential level of input node Ni, i.e., of reference potential signal Vr1, is not higher than a predetermined value at the time of power on.

Activation control circuit 650-1 compares the potential level of reference node Ns with that of input node Ni to detect the activation of an external power-supply, and raise control signal ALV1 to the level H for activation. Therefore, primary reference potential signal Vr0 which would rise earlier than reference potential signal Vr1 at the time of power on, is input to reference node Ns of activation circuit 650-1.

Correspondingly, activation control circuit 650-2 sets control signal ALV2 generated at output node No to the activated state, if the potential level of input node Ni, i.e., internal power-supply potential Vcc1 is not more than a predetermined value -at the time of power on.

In activation control circuit 650-2, reference potential signal Vr1 which would rise earlier than internal power-supply potential Vcc1 at the time of power on, is input to reference node Ns for detecting activation of an external power-supply.

Though different potential signals are input to/output from input node Ni, reference node Ns and output node of activation control circuits 650-1 and 650-2, these circuits have the same circuit configuration. Therefore, the configuration of activation control circuit 650-1 will be representatively described.

Figure 4:
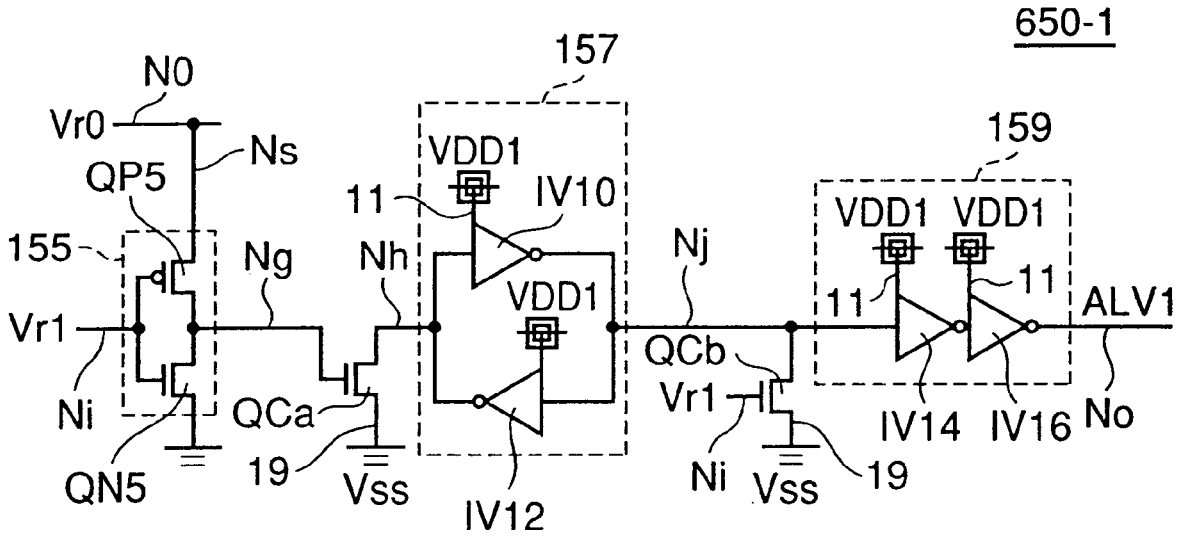
FIG. 4 is a circuit diagram illustrating a configuration of an activation control circuit 650-1.

Referring to FIG. 4, activation control circuit 650-1 includes a P-type transistor QP5 electrically coupled between reference node Ns and internal node Ng, and an N-type MOS transistor QN5 electrically coupled between internal node Ng and ground line 19 which supplies a ground voltage Vss. The gates of transistors QN5 and QP5 are coupled to input node Ni. Transistors QP5 and QN5 form an inverter 155 driven by reference potential signal Vr0 and ground voltage Vss. Input node Ni is electrically coupled to node N1 at which reference potential signal Vr1 is generated.

In activation control circuit 650-1, reference node Ns is coupled to node N0 at which primary reference potential signal Vr0 is generated.

Activation control circuit 650-1 further includes: an N-type MOS transistor QCa electrically coupled between internal node Nh and ground line 19, and having a gate coupled to internal node Ng; an N-type MOS transistor QCb electrically coupled between internal node Nj and ground line 19, having a gate coupled to input node Ni; and inverters IV10 and IV12 forming a latch circuit 157 for latching the potential level of internal nodes Nh and Nj.

Activation control circuit 650-1 further includes inverters IV14 and IV16 forming a signal buffer 159 for generating control signal ALV1 to output node No, in accordance with the potential level of internal node Nj. Inverters IV10, IV12, IV14 and IV16 are driven by external power-supply line 11. Therefore, the potentials at levels H and L of control signal ALV1 respectively correspond to external power-supply potential VDD1 and ground potential Vss.

Operation of activation control circuit is now described. At the time of power on, when reference potential signal Vr1 rises from ground potential Vss, primary reference potential signal Vr0 transmitted to reference node Ns rises earlier than reference potential signal Vr1, so that transistor QP5 turns on, and then the potential level of internal node Ng will be equal to that of reference node Ns, i.e., to reference potential signal Vr0.

If the potential of node Ng exceeds the threshold voltage of transistor QCa, a current path is formed, by transistor QCa, between internal node Nh and ground line 19, and the potential level of internal node Nh is set to the level L (ground potential Vss). This allows the potential levels of internal nodes Nh and Nj latched by latch circuit 157 to be set respectively to the levels L and H (external power-supply potential VDD1). Accordingly, the potential level of output node No is also set to the level H. This allows control signal ALV1 to be activated (to the level H). Latch circuit 157 holds the potential levels of internal nodes Nh and Nj, so that the activated state (level H) of control signal ALV1 is maintained.

Thereafter, when the potential level of input node Ni, i.e., of reference potential signal Vr1 rises, a discharge path is formed between internal node Nj and ground line 19 by transistor QCb. This changes the potential level of internal node Nj from the H to L. By properly adjusting the threshold voltage and current driving power of transistor QCb, at the time point when the potential level of input node Ni reaches a predetermined value, the potential level of node Nj can be inverted to the level L to inactivate (to level L) control signal ALV2.

Such a configuration allows activation control circuit 650-1 to activate control signal ALV1 in response to the activation of an external power-supply, and the activated state of control signal ALV1 is maintained until the potential level of reference potential signal Vr1 reaches a predetermined value. This enables high-speed operation of reference potential signal generating circuit 120 during a desired period at the time of power on.

However, since node N0 where reference potential signal Vr0 is generated is a high impedance node, through current is generated on the path running from reference node Ns (coupled to node N0) through transistors QP5 and QN5 to ground line 19, when reference potential signal Vr1 is in a state of intermediate potential at the rise after the power is on. This possibly causes the potential level of reference node Ns, i.e., of primary reference potential signal Vr0, to be temporarily lowered. This problem may also be experienced in activation control circuit 650-2, in which the potential level of reference potential signal Vr1 may temporarily be lowered at the rise after the power-on.

A problem of voltage generating circuit 600 will be described in more detail with reference to FIG. 5.

Figure 5:
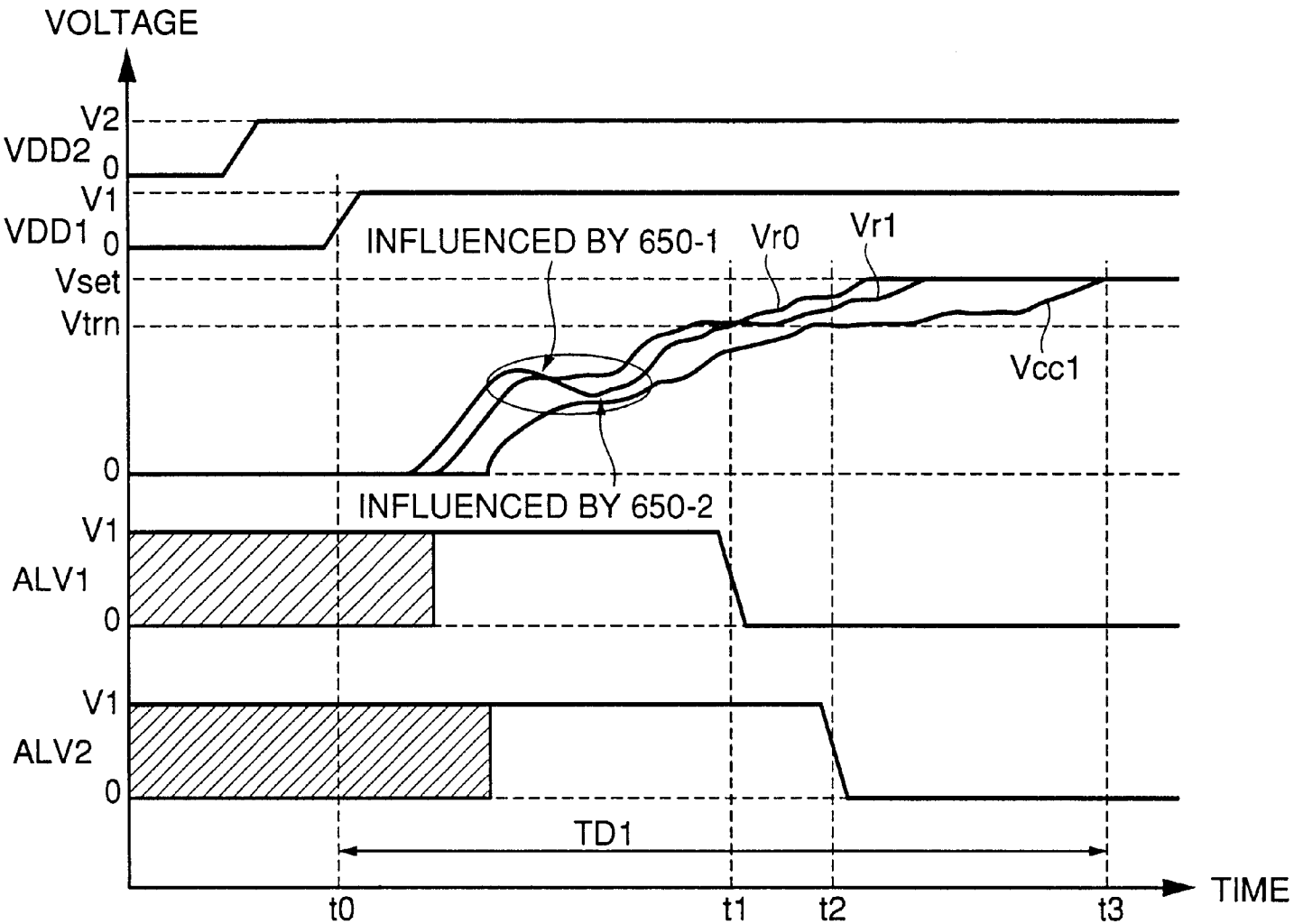
FIG. 5 is a timing chart illustrating a problem of voltage generating circuit 600.

Referring to FIG. 5, an external power-supply is activated at time point t0, and external power-supply potential VDD rises. In response, generation of primary reference potential signal Vr0 and reference potential signal Vr1 for adjusting internal power-supply potential Vcc1 to a set potential level Vset starts.

At an initial state after the power-supply is turned on, control signals ALV1 and ALV2 are both activated (to level H), which increases the operational speed of reference potential signal generating circuit 120 faster and activates active VDC 130.

However, in activate control circuits 650-1 and 650-2, because of through current generated at inverter 155 at an input stage, the potential level of reference node Ns, i.e., of primary reference potential signal Vr0 and reference potential signal Vr1, temporarily lowers, as described above. Accordingly, primary reference potential signal Vr0 and reference potential signal Vr1 will not monotonously rise, but rather be lowered once in its potential level and then will start to rise again. This delays the rise of reference potential signal Vr1, and also delays the rise of internal power-supply potential Vcc1 correspondingly.

It may be possible to prevent decrease of the potential levels of primary potential signal Vr0 and reference potential signal Vr1, by coupling a capacitance for stabilizing the potential levels to nodes N0 and N1. In such a case, however, an increased amount of electric charges will be required for charging nodes N0 and N1 at the time of power on, rather hindering rapid rise of these potential signals.

At time point t1, when reference potential signal Vr1 reaches a predetermined potential Vtrn, control signal ALV1 is inactivated. This stops operational current supplied from transistor QC2, terminating high-speed operation of reference potential signal generating circuit 120. Correspondingly, at time point t2, when the potential level of internal power-supply potential Vcc1 reaches predetermined potential Vtrn, transistor QC3 stops supplying the operational current, which inactivates active VDC130.

After time point t2, internal power-supply line 15 continues to be gradually charged only by stand-by VDC 135, and at time point t3, internal power-supply potential Vcc1 reaches set potential Vset. A predetermined potential Vtrn is set to a value lower than a set potential with a certain difference, in order to prevent overshooting of internal power-supply potential Vcc1 from set potential Vset, and to avoid variation and increase of Vtrn such that Vtrn is greater than set potential Vset by a process variation of transistor parameter or the like. Generally, predetermined potential Vtrn is preferably set to a potential at least 0.3V lower than set potential Vset.

Thus, between time points t0 and t1, through current generated at inverter 155 in an activation control circuit temporarily lowers reference potential signal Vr1, so that rapid rise of internal power-supply potential Vcc1 is disadvantageously prevented.

[Configuration of Voltage Generating Circuit According to the First Embodiment]

Figure 6:
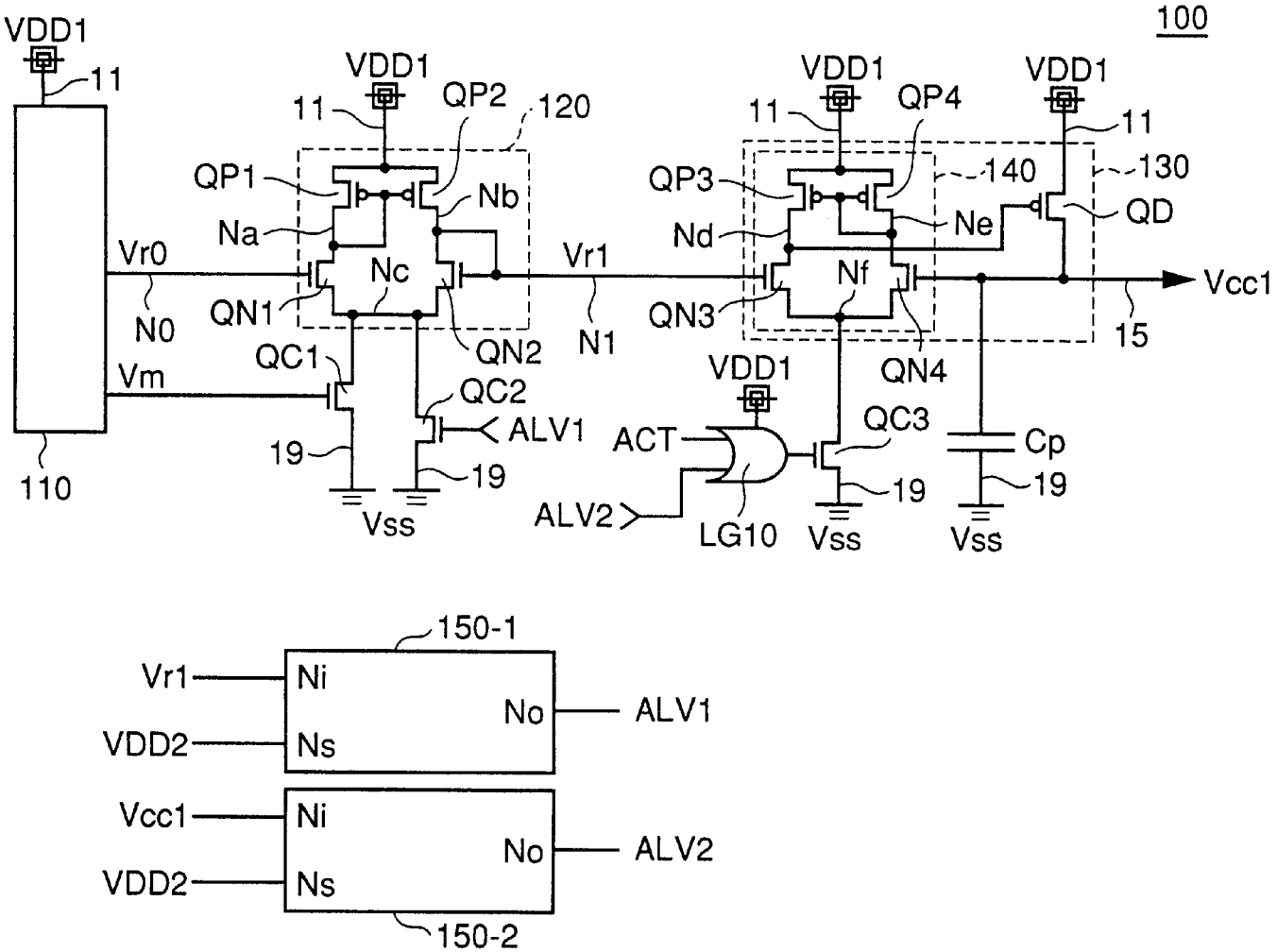
FIG. 6 is a circuit diagram showing a configuration of voltage generating circuit 100 according to the first embodiment.

Referring to FIG. 6, voltage generating circuit 100 according to the first embodiment of the present invention is different from voltage generating circuit 600 shown in FIG. 2, in the respect that activation control circuits 150-1 and 150-2 are included in place of activation control circuits 650-1 and 650-2.

Activation control circuits 150-1 and 150-2 include circuit configurations similar to those of activation control circuits 650-1 and 650-2, and respectively generate control signals ALV1 and ALV2. However, activation control circuits 150-1 and 150-2 are different from activation control circuits 650-1 and 650-2, in the respect that an external power-supply potential VDD2, which is independent of generation of primary reference potential Vr0 and reference potential signal Vr1, is input to reference node Ns.

Other parts such as primary reference potential signal generating circuit 110, reference potential signal generating circuit 120, active VDC, transistors QC1-QC3 for controlling current, and logic gate LG10 are the same as the ones described with reference to FIG. 2, so that descriptions thereof will not be repeated.

Though different potential signals are input to/ output from input node Ni, reference node Ns and output node of activation control circuits 150-1 and 150-2, these circuits have the same circuit configuration. Therefore, the configuration of activation control circuit 150-1 will be representatively described with reference to FIG. 7.

Figure 7:
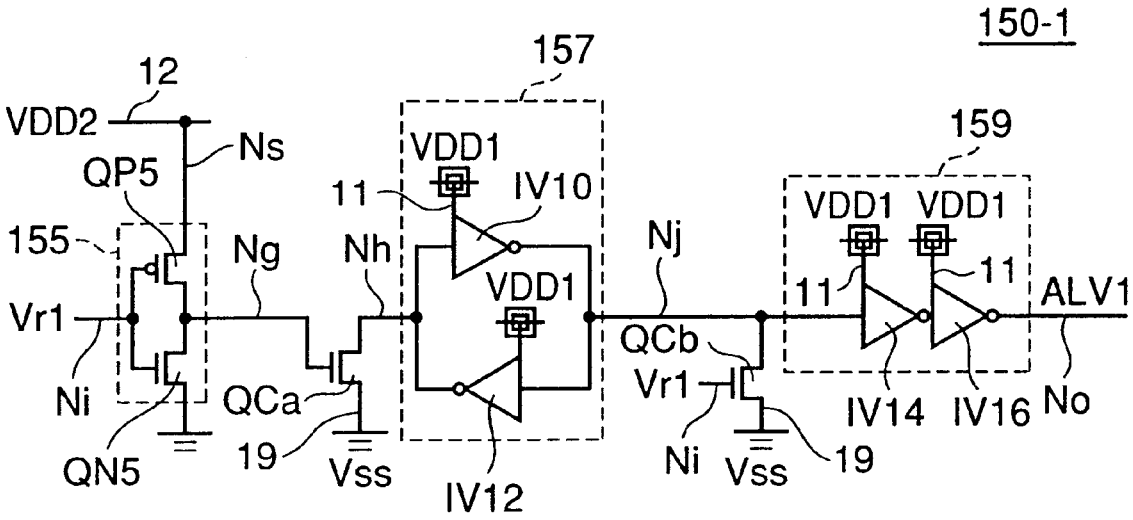
FIG. 7 is a circuit diagram showing a configuration of activation control circuit 150-1 according to the first embodiment.

Referring to FIG. 7, reference node Ns is electrically coupled to external power-supply line 12 supplying independent external power-supply potential VDD2. The other parts are the same in their configuration and operation as the ones shown in FIG. 4, so that the detailed description thereof will not be repeated.

Thus, the potential independent of generation of reference potential signal Vr1 is input to reference node Ns of activation control circuit 150-1. Therefore, even if through current is generated in inverter 155, varying the potential level of reference node Ns at the initial state of rise of the voltage levels of input node Ni and reference node Ns when the power-supply is turned on, this would not adversely affect the potential level of reference potential signal Vr1. When direct potential from an external power-supply, such as external power-supply potential VDD2, is assigned to reference node Ns, the potential level of reference node Ns can sufficiently be maintained even if through current is generated in inverter 155.

Correspondingly, in activation control circuit 150-2, a potential signal independent of generation of internal power-supply potential Vcc1 is input to reference node Ns, so as to prevent delay in rising of the potential level of internal power-supply potential Vcc1. For example, in activation control circuit 150-2, reference node Ns may be electrically coupled to external power-supply line 12.

Figure 8:
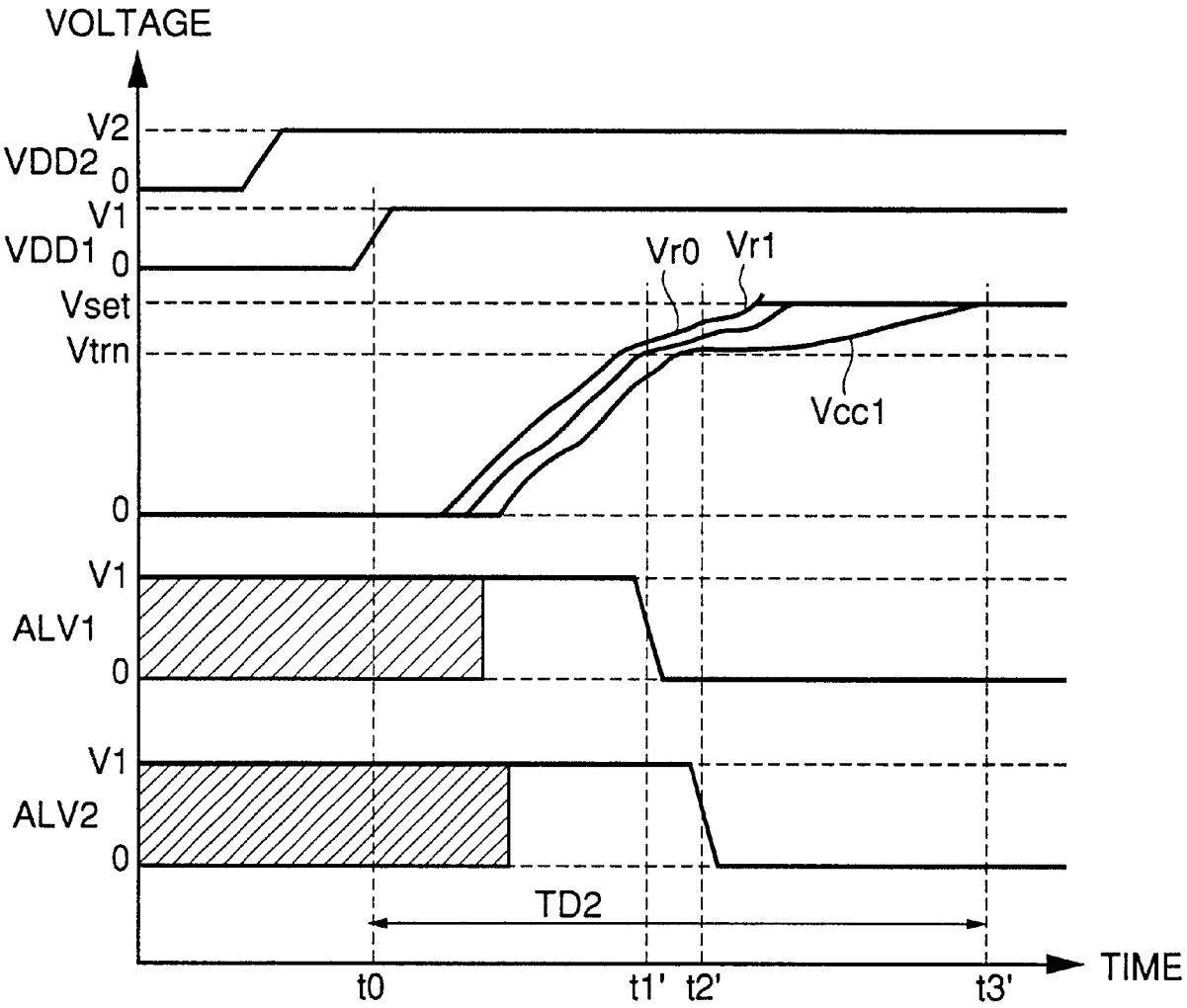
FIG. 8 is a timing chart illustrating an operation of voltage generating circuit 100.

The operation of voltage generating circuit 100 will now be described with reference to FIG. 8. Referring to FIG. 8, external power-supply potential VDD1 is activated at time point to. Though in FIG. 8, an example is shown where external power-supply potential VDD2 is activated earlier than external power-supply potential VDD1, external power-supply potential VDD2 may only be activated on or before time point t0 at which generation of primary reference potential signal Vr0 and reference potential signal Vr1 is started.

After external power-supply potential VDD1 is activated, control signals ALV1 and ALV2 are activated (to level H), and primary reference potential signal Vr0 and reference potential signal Vr1 rise. Accordingly, internal power-supply potential Vcc1 also rises under control.

In voltage generating circuit 100, is free from the problem that activation control circuits 150-1 and 150-2 affect the potential levels of primary reference potential signal Vr0 and reference potential signal Vr1 to make the signals lower. Therefore, internal power-supply potential Vcc1 will rise rapidly.

Therefore, time point t1' at which reference potential signal Vr1 reaches predetermined potential Vtrn and time point t2' at which internal power-supply potential Vcc1 reaches predetermined potential Vtrn will be earlier than time points t1 and t2 shown in FIG. 5. This shortens time period TD2 during which internal power-supply potential Vcc1 reaches from external power on (time point t0) to set potential Vset, compared to time period TD1 shown in FIG. 5.

Thus, internal power-supply potential rises more rapidly at the time of power on, with the overshoot suppressed by stepwise generation of the reference potential signal.

In voltage generating circuit 100, it is not always required to input an independent external power-supply potential. The potential input to reference nodes Ns of activation control circuits 150-1 and 150-2 is only required to rise earlier than the potential signal input to input node Ni at the time of power on, and to be independent of primary reference potential signal Vr0 and reference potential signal Vr1. The independence from those signals means that the nodes Ns are electrically separated from a node affecting potential levels of Vr0 and Vr1.

The potential level of the signal transmitted to reference node Ns is required to be set greater than the threshold voltage of transistor QCa. This is because, in order to activate control signals ALV1 and ALV2 at the time of power on, it is necessary to electrically couple node Nh and ground line 19 by transistor QCa receiving the potential level of reference node Ns at the gate thereof, to form a current path.

Further, if the potential level of reference node Ns is not more than that of input node Ni at a steady state, generation of steady through current in inverter 155 can be prevented so as to reduce consumption current of activation control circuits 150-1 and 150-2. Thus, the potential level of reference node Ns should preferably be lower than that of input node Ni at the steady state.

Second Embodiment

In the first embodiment, a configuration has been described in that reference nodes Ns of activation control circuits 150-1 and 150-2 are coupled to an external power-supply line independent of the generation of primary reference potential signal Vr0 and reference potential signal Vr1 to improve the rising property of internal power-supply potential Vcc.

However, in some cases, the standards of rise time at the time of power on may not be so strict, depending on a specification of a semiconductor device on which a voltage generating circuit is mounted. In such cases, for example, the configuration of voltage generating circuit 600, in which reference node Ns is coupled to primary reference potential signal Vr0 and reference potential signal Vr1, may satisfy the specification.

To improve the rising property of internal power-supply potential Vcc1 by the configuration of voltage generating circuit 100, it would be necessary for both of a plurality of external power-supply potentials VDD1 and VDD2 to be normally activated, in order to normally control the rise of internal power-supply potential Vcc1. Therefore, dependent on the specification of a semiconductor device, where no particularly high-speed rising property is required, for example, it may be more reasonable to apply the configuration of voltage generating circuit 600 shown in FIG. 2, which generates internal power-supply potential Vcc1 based on a single external power-supply potential VDD1.

Figure 9:
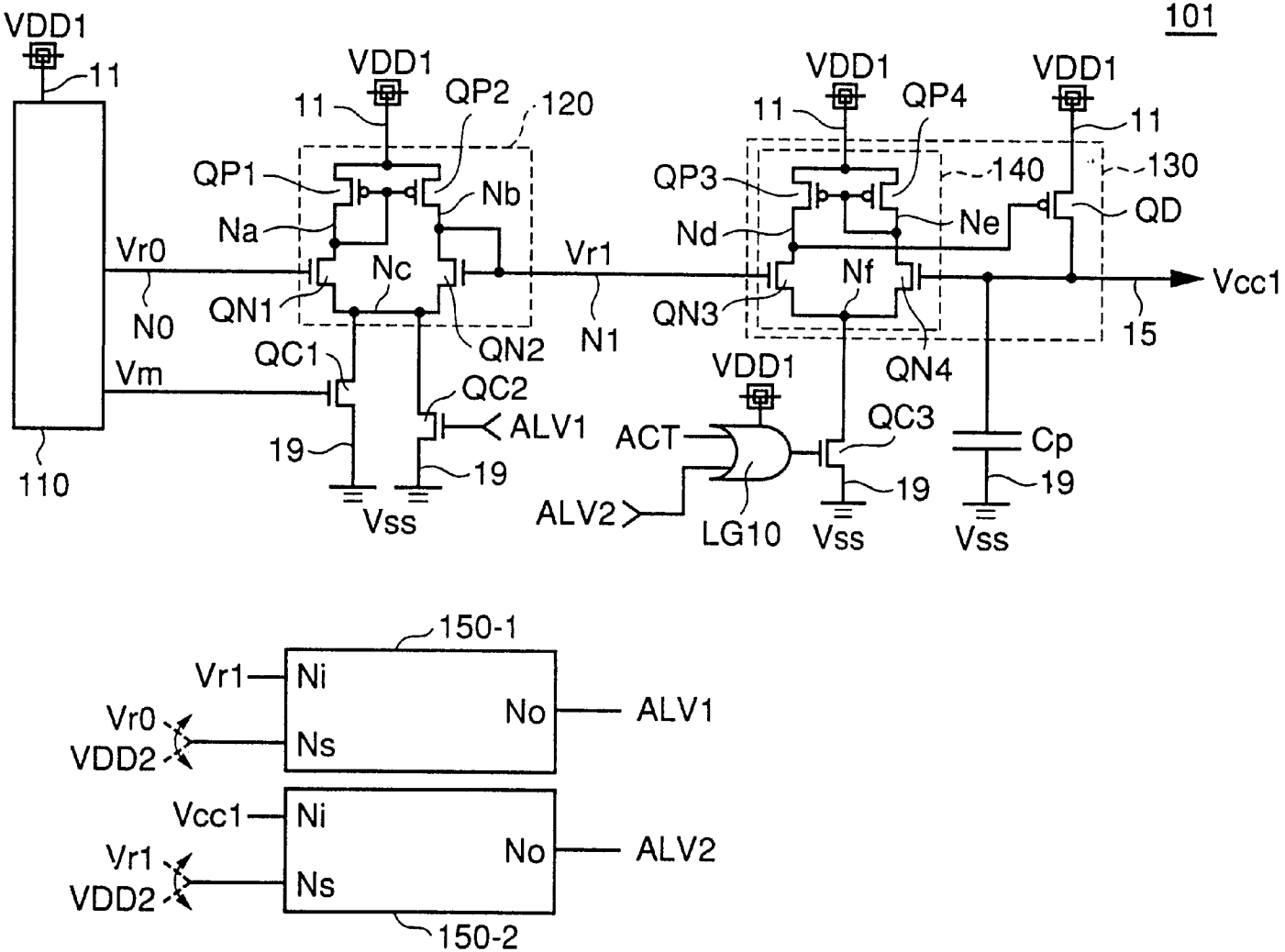
FIG. 9 is a circuit diagram showing a configuration of a voltage generating circuit 101 according to the second embodiment of the present invention.

Referring to FIG. 9, voltage generating circuit 101 according to the second embodiment of the present invention has a configuration similar to the voltage generating circuit according to the first embodiment, except that, in activation control circuits 150-1 and 150-2, one of the configurations of voltage generating circuit 600 shown in FIG. 2 and voltage generating circuit 100 shown in FIG. 6 can be realized by selecting a coupling for reference node Ns.

A structure of voltage generating circuit 101 will be described in which the selection of such coupling of a node can easily be performed at the time of manufacturing a semiconductor device.

Figure 10:
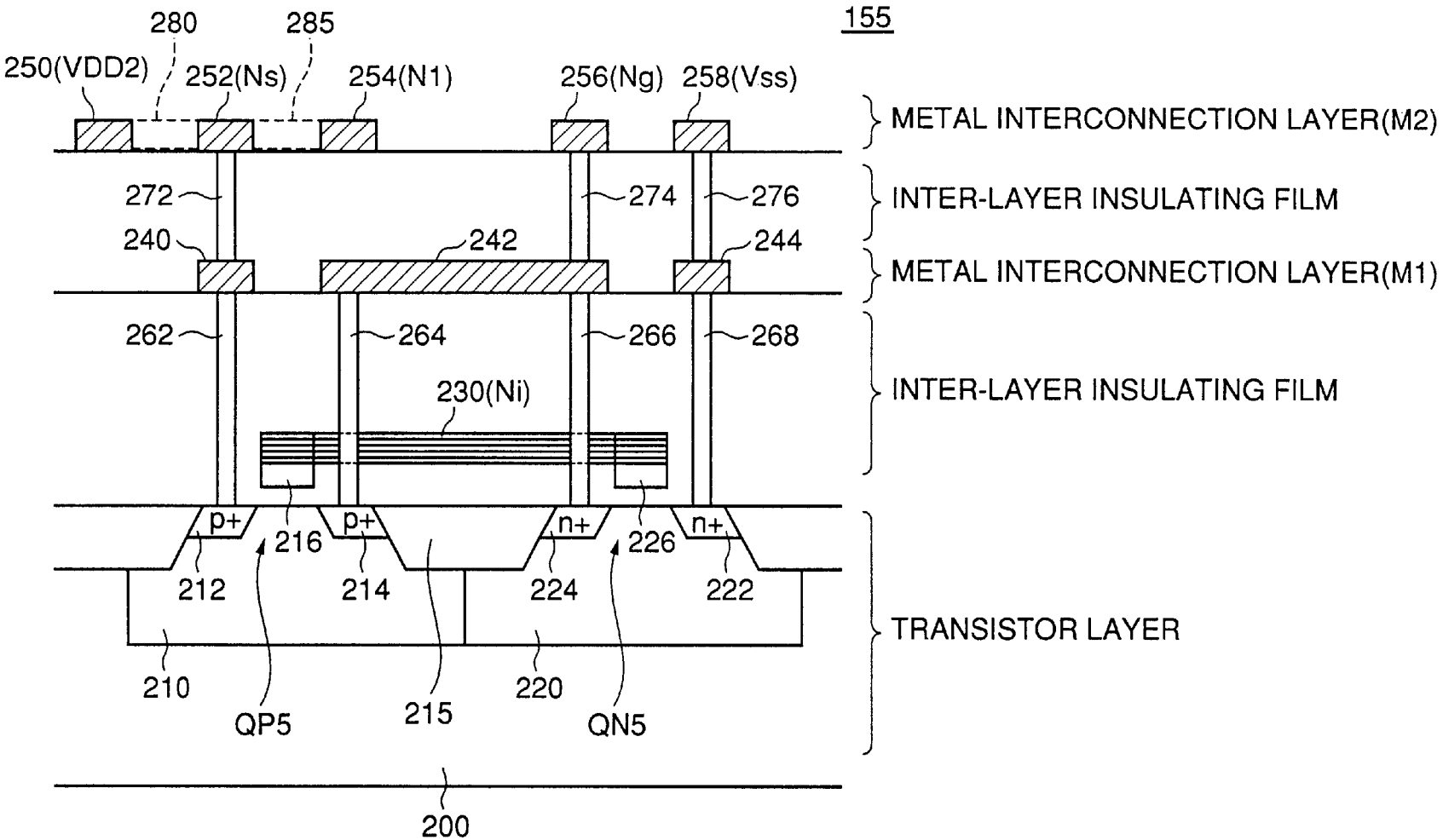
FIG. 10 is a sectional view illustrating a structure of a portion associated with a reference node Ns.

FIG. 10 represents a sectional view of inverter 155 associated with the coupling of reference node Ns in activation control circuit 150-2.

Referring to FIG. 10, an N-type well 210 and a P-type well 220 are formed on a main substrate 200. A P-type MOS transistor QP5 is formed on N-type well 210. Transistor QP5 includes a P-type region corresponding to a source 212 and a drain 214, and a gate 216.

An N-type MOS transistor QN5 is formed on P-type well 220. Transistor QN5 includes an N-type region corresponding to a source 222 and a drain 224, and a gate 226. Gate 216 of transistor QP5 and gate 226 of transistor QN5 are coupled by an interconnection 230. Interconnection 230 corresponds to input node Ni, and is coupled to internal power-supply line 15 (not shown). An element-isolating oxide film 215 is provided between transistors QN5 and QP5.

Interconnections 240, 242 and 244 are formed in a metal interconnection layer M1. Interconnection 242 is coupled to drain 214 of transistor QP5 and drain 224 of transistor QN5, with through holes 264 and 266 provided in an inter-layer insulating layer interposed. Interconnection 240 is electrically coupled to source 212 of transistor QP5, via through hole 262. Interconnection 244 is coupled to source 222 of transistor QN5, via a through hole 268.

Interconnections 250, 252, 254, 256 and 258 are formed in a metal interconnection layer M2. Interconnection 250 is coupled to external power-supply line 12 (not shown) transmitting external power-supply potential VDD2. Interconnection 252 corresponds to reference node Ns of activation control circuit 250-2. Interconnection 254 corresponds to node N1 transmitting reference potential signal Vr1. Interconnection 256 corresponds to node Ng, which is an output node of inverter 155. Interconnection 258 is coupled to ground potential Vss (not shown).

Such a configuration allows an interconnection to be formed at either one of a region 280 between interconnections 252 and 250, and a region 285 between interconnections 252 and 254, so that one of the coupling manners of reference nodes Ns in voltage generating circuits 100 and 600 can selectively be realized.

Selection of the manner of forming the interconnections described above can easily be performed by switching a metal mask used for the corresponding metal interconnection layer M2. This allows one of the configurations of voltage generating circuits 100 and 600 to be simply selected and formed on a semiconductor device, in accordance with the specification of the semiconductor device.

Similar structure can also be applied to activation control circuit 150-1. In this case, selective realization of the coupling manner between reference node Ns, node N0 and external power-supply line 12 can also be simply enabled by switching a metal mask, if the first interconnection corresponding to reference node Ns of activation control circuit 252-2, the second interconnection corresponding to node N0 transmitting reference potential signal Vr0, and the third interconnection coupled to external power-supply line 12 transmitting external power-supply potential VDD2 are provided on the same metal interconnection layer.

Third Embodiment

In the third embodiment, a description will be made for the control of internal power-supply potential at the time of power on in a semiconductor device having a plurality of power-supply systems.

Figure 11:
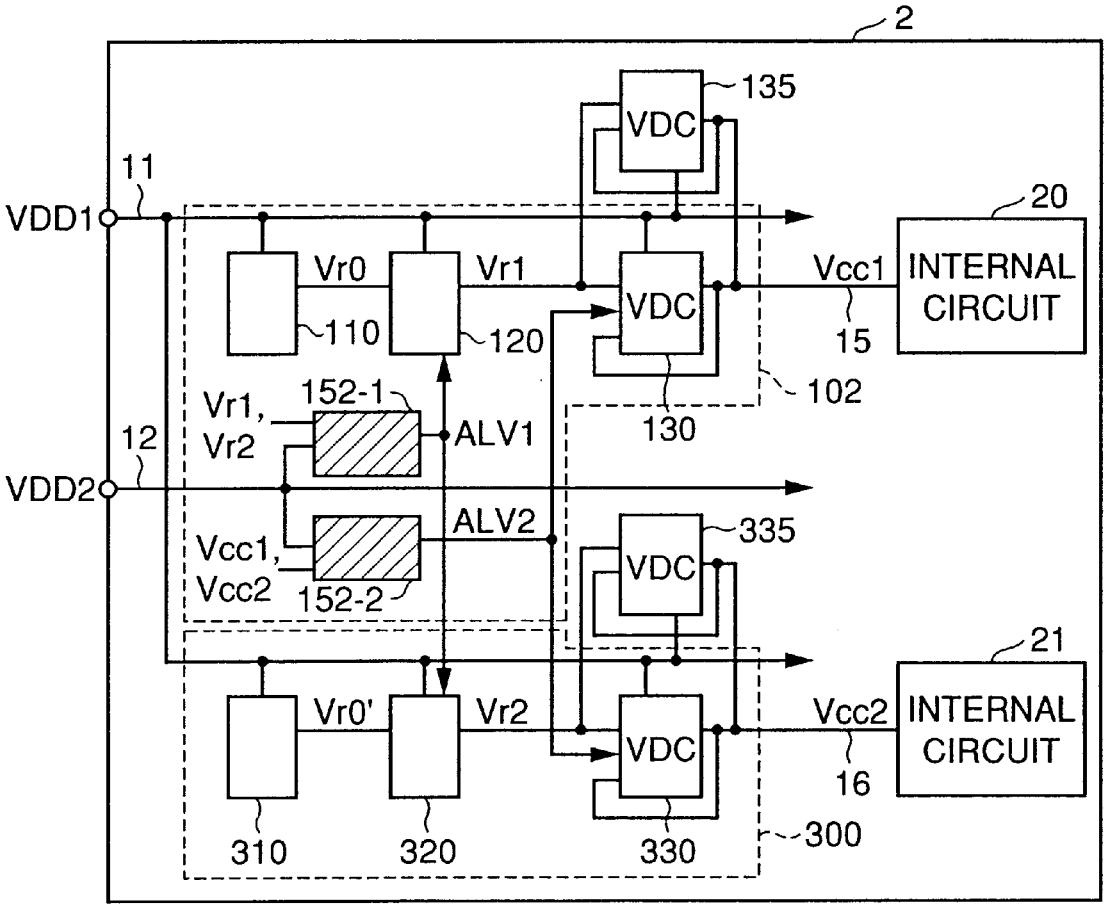
FIG. 11 is a schematic block diagram showing a configuration of a semiconductor device 2 according to the third embodiment of the present invention.

Referring to FIG. 11, a semiconductor device 2 according to the third embodiment of the present invention includes, compared with semiconductor device 1 shown in FIG. 1, a power-supply system generating an internal power-supply potential Vcc2, a voltage generating circuit 300 generating internal power-supply potential Vcc2 at inter power-supply line 16, and an internal circuit 21 supplied with internal power-supply potential Vcc2 from internal power-supply line 16, for operation.

Voltage generating circuit 300 has a configuration similar to that of voltage generating circuit 100, and includes a primary reference potential signal generating circuit 310, a reference potential signal generating circuit 320 and an active VDC 330, respectively corresponding to a primary reference potential signal generating circuit 110, a reference potential signal generating circuit 120 and active VDC 130. Primary reference potential signal generating circuit 310 generates a primary reference potential signal Vr0', whereas reference potential signal generating circuit 320 generates a reference potential signal Vr2. Further, as in the case with the power-supply system of internal power-supply potential Vcc1, a stand-by VDC 335 is arranged in parallel with active VDC 330.

Thus, though voltage generating circuits 300 and 100 are different in the generating levels of internal power-supply potentials, the circuit configurations for generating the internal power-supply potentials are similar to each other.

A voltage generating circuit 102 according to the third embodiment is different from voltage generating circuit 100, in the respect that activation control circuits 152-1 and 152-2 are included therein in place of activation control circuits 150-1 and 150-2. Control signals ALV1 and ALV2 generated by activation control circuits 152-1 and 152-2 are shared between voltage generating circuit 102 generating internal power-supply potential Vcc1 and voltage generating circuit 300 generating internal power-supply potential Vcc2.

Figure 12:
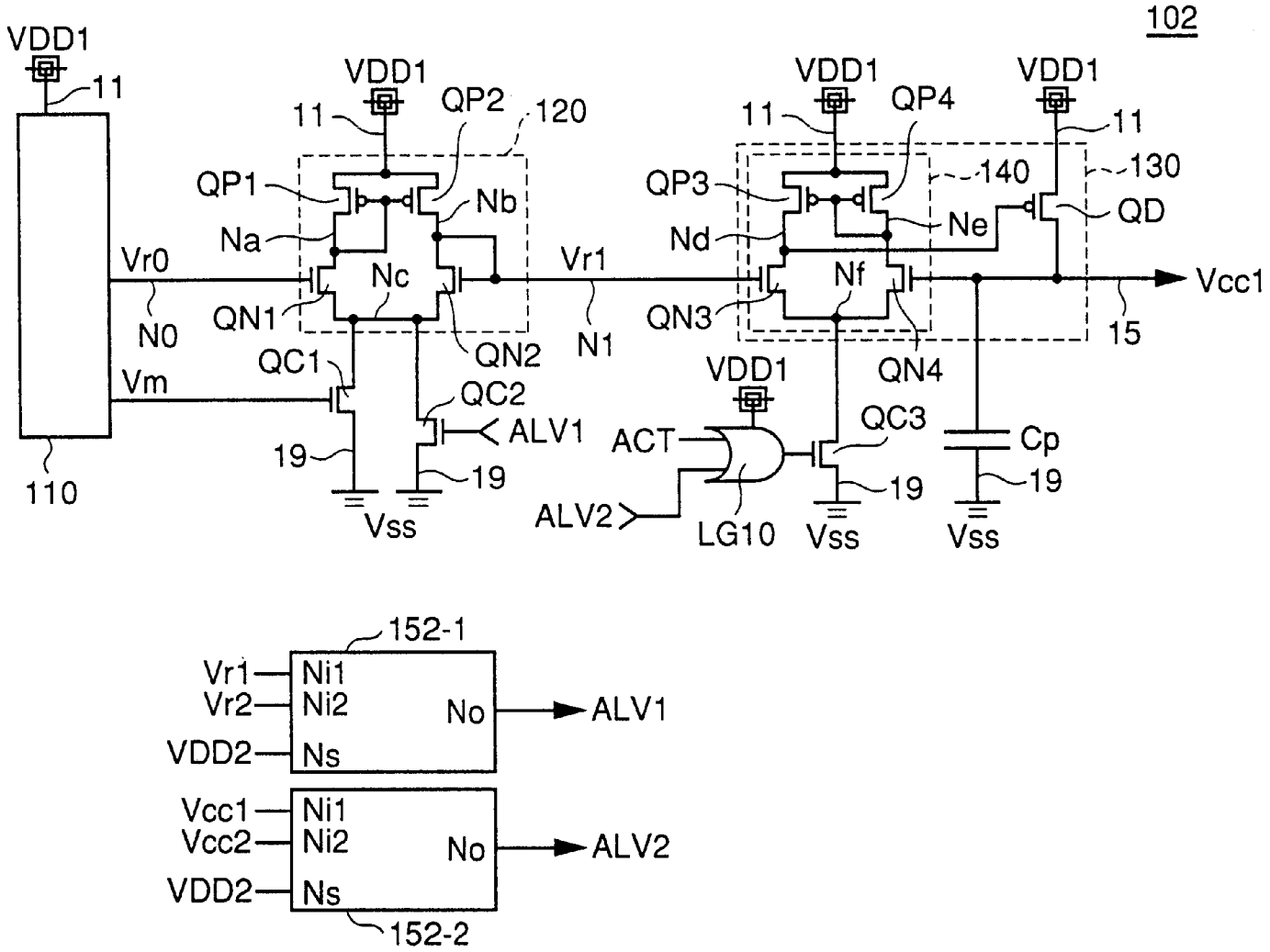
FIG. 12 is a circuit diagram of a configuration of a voltage generating circuit 102 according to the third embodiment of the present invention.

Referring to FIG. 12, voltage generating circuit 102 according to the third embodiment of the present invention is different from voltage generating circuit 100 shown in FIG. 6, in the respect that activation control circuits 152-1 and 152-2 are included in place of activation control circuits 150-1 and 150-2. Activation control circuits 152-1 and 152-2 are characterized in that control signals ALV1 and ALV2 are activated and inactivated across a plurality of voltage generating circuits (power-supply systems).

Thus, activation control circuits 152-1 and 152-2 include two input nodes Ni1 and Ni2, respectively activating control signals ALV1 and ALV2 in accordance with the relation between the potential levels of reference node Ns and input node Ni1, and respectively inactivating control signals ALV1 and ALV2 in accordance with the potential level of input node Ni2.

Though different potential signals are input to/output from input nodes Ni1 and Ni2, reference node Ns and output node No of activation control circuits 152-1 and 152-2, these circuits have the same circuit configurations. Therefore, the configuration of activation control circuit 152-2 will representatively be described.

Figure 13:
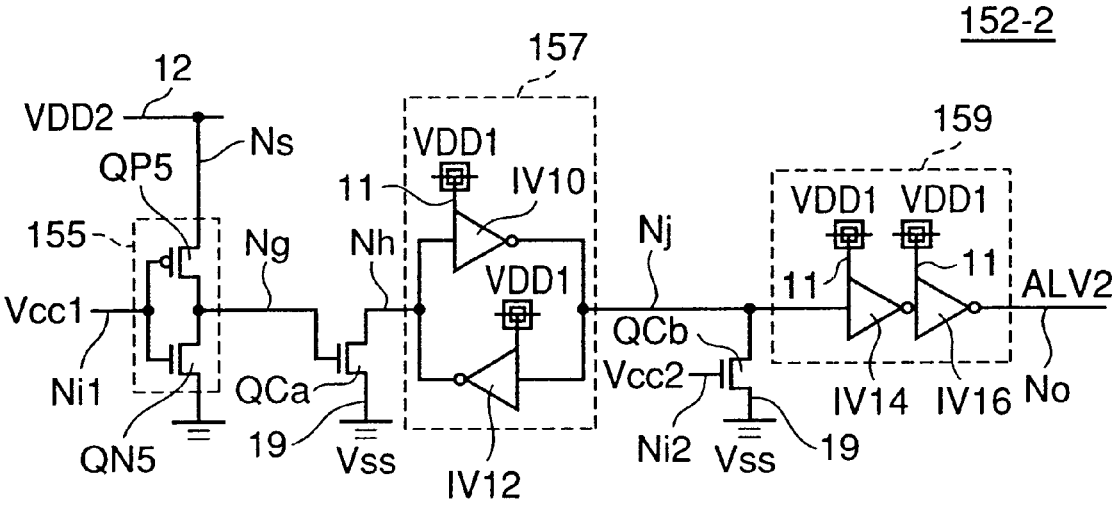
FIG. 13 is a circuit diagram showing a configuration of an activation control circuit 152-2.
Figure 14:
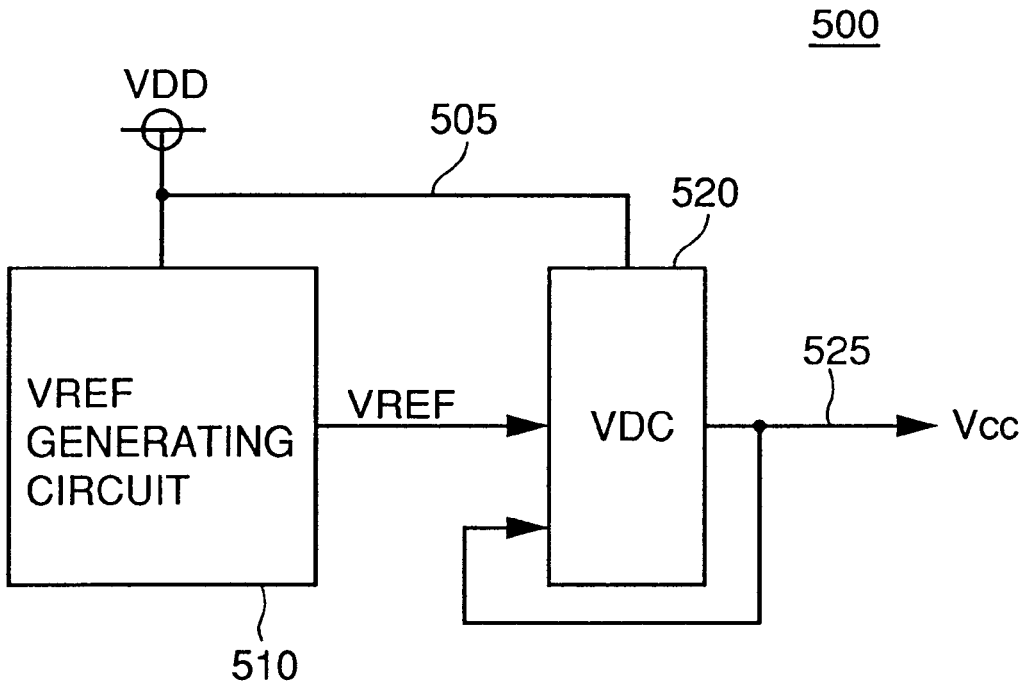
FIG. 14 PRIOR ART
FIG. 14 is a schematic block diagram showing a configuration of a voltage generating circuit in general.

Referring to FIG. 13, activation control circuit 152-2 is different from activation control circuit 150-1 shown in FIG. 7, in the respect that the input of inverter 155 is coupled to internal node Ni1, and that the gate of transistor QCb is coupled to internal node Ni2. Other configurations and operations are similar to that of activation control circuit 150-1 shown in FIG. 7, so that the description thereof will not be repeated.

By such a configuration, the potential level of node Ng at the time of power on, i.e., the level of control signal ALV2 generated at output node No, is activated (to level H) when the potential level of reference node Ns rises earlier than that of node Ni1, and is inactivated (to level L) when the potential level of internal node Ni2 becomes no lower than a predetermined value.

Referring again to FIG. 12, activation control circuit 152-1 receives reference potential signal Vr1 corresponding to internal power-supply potential Vcc1 at input node Ni1, and reference potential signal Vr2 corresponding to internal power-supply potential Vcc2 at input node Ni2. Correspondingly, activation control circuit 152-2 receives internal power-supply potential Vcc1 generated by voltage generating circuit 102 at input node Ni1, and internal power-supply potential Vcc2 generated by voltage generating circuit 300 at input node Ni2.

An internal power-supply potential generated by each of the voltage generating circuits significantly vary in its rising property, in accordance with the configuration of a load to which the potential is applied, and on the difference in capacitance added to the node at which the internal power-supply potential is generated. Therefore, considering the difference in the rising property of each internal power-supply potential, one control signal can be shared across a plurality of voltage generating circuits, by activating and inactivating control signals ALV1 and ALV2, for example, appropriately corresponding to the fastest or the slowest one of the rising properties of the plurality of voltage generating circuits. Though two power-supply systems are shown and two internal power-supply potentials and voltage generating circuits are respectively employed in FIG. 11 by way of example, the present invention according to the third embodiment may also be applied to an example in which a plurality (two or more) of optional power-supply systems are employed.

This eliminates the need for arranging the activation control circuit, for increasing speed of rise of each internal power-supply potential at the time of power on, for each voltage generating circuit, i.e., for each power-supply system, so that the circuit area can be reduced.

In the first to third embodiments of the present invention, configurations of primary reference potential signal 110 and reference potential signal generating circuit 120 are exemplary shown, in which a reference potential for controlling an internal power-supply potential is generated in two steps by primary reference potential signal Vr0 and reference potential signal Vr1. However, the present invention is not limited to such an example, but rather can be applied to another example such as the one where the reference potential is generated in a multiple of (no less than three) steps, by further providing a similar activation control circuit as the number of the steps is increased.

Further, the present invention can also be applied for activation control of active VDC 130 by activation control circuit 150-2 or 152-2 at the time of power on, when a configuration is used in which no reference potential generating circuit 120 is provided and primary reference potential signal Vr0 is input to active VDC 130, i.e., node N1.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A semiconductor device, supplied with a first external power-supply potential from a first external power-supply, for operation, comprising:

an external power-supply line transmitting said first external power-supply potential; and a voltage generating circuit converting said first external power-supply potential received from said external power-supply line into an internal power-supply potential to be supplied to an internal power-supply line;

said voltage generating circuit including a reference potential generating unit receiving said first external power-supply potential from said external power-supply line to generate a reference potential signal, corresponding to a set potential level of said internal power-supply potential, at a first intermediate node, a voltage converting circuit supplying an amount of current, corresponding to a difference between potential levels of said internal power-supply line and said first intermediate node, from said external power-supply line to said internal power-supply line, a first current-supply circuit supplying a first operational current to said voltage converting circuit during an activation period of a first control signal, and a first activation control circuit activating said first control signal for a period from activation of said first external power-supply until the potential level of said internal power-supply line reaches a predetermined level, said first activation control circuit detecting said activation of said first external power-supply by comparing potential level of a first reference node transmitting a first potential with that of said internal power-supply line, said first reference node being electrically separated from a node affecting a potential level of said reference potential signal;

said semiconductor device further comprising:

an internal circuit receiving said internal power-supply potential from said internal power-supply line, for operation.

2. The semiconductor device according to claim 1, wherein said semiconductor device is further supplied with a second external power-supply potential from a second external power-supply, for operation, and said first reference node is electrically coupled to said second external power-supply potential.

3. The semiconductor device according to claim 2, wherein said second external power-supply is activated at a timing same as, or earlier than, that of said first external power-supply.

4. The semiconductor device according to claim 1, wherein said first control signal has a first signal level corresponding to an activated state, and a second signal level corresponding to an inactivated state, said first activation control circuit includes a first field effect transistor electrically coupled between said first reference node and a first internal node, and having a gate electrically coupled to said internal power-supply line, a second field effect transistor electrically coupled between said first internal node and a potential supply node supplying a potential corresponding to said second signal level, and having a gate electrically coupled to said internal power-supply line, a third field effect transistor electrically coupled between a second internal node and said potential supply node, and having a gate electrically coupled to said first internal node, a fourth field effect transistor electrically coupled between a third internal node and said potential supply node, and having a gate electrically coupled to said internal power-supply line, a latch circuit setting and holding potentials of said second and third internal nodes to respective ones of two potentials corresponding to said first and second signal levels respectively, in accordance with potentials of said second and third internal nodes, and a signal buffer generating said first control signal in accordance with a potential of said third internal node.

5. The semiconductor device according to claim 4, wherein said third field effect transistor can form a current path between said second internal node and said potential supply node when said first direct potential is input to the gate via said first field effect transistor.

6. The semiconductor device according to claim 4, wherein said first potential is no higher than said set potential level of said internal power-supply potential.

7. The semiconductor device according to claim 1, wherein:

said reference potential generating unit includes a primary reference potential generating circuit receiving said first external power-supply potential from said external power-supply line, to generate a primary reference potential signal for generating said reference potential signal at a second intermediate node, and a reference potential generating circuit charging said first intermediate node in accordance with a difference between potential levels of said second intermediate node and said first intermediate node;

said voltage generating circuit further includes a second current-supply circuit for supplying a second operational current to said reference potential generating circuit, a third current-supply circuit for supplying a third operational current larger than said second operational current to said reference potential generating circuit, during an activation period of said second control signal, and a second activation control circuit activating said second control signal for a period from activation of said first external power-supply until a potential level of said first intermediate node reaches a predetermined level;

said second activation control circuit detecting said activation of said first external power-supply by comparing a potential level of a second reference node transmitting a second potential with a potential level of said first intermediate node, said second reference node being electrically separated from affecting a potential level of at least one of said primary reference potential signal and said reference potential signal.

8. The semiconductor device according to claim 7, wherein said semiconductor device is further supplied with a second external power-supply potential from said external power-supply, for operation, and said second reference node is coupled to said second external power-supply potential.

9. The semiconductor device according to claim 8, wherein said second external power-supply is activated at a timing same as, or earlier than, that of said first external power-supply.

10. The semiconductor device according to claim 7, wherein said second control signal includes a first signal level corresponding to an activated state, and a second signal level corresponding to an inactivated state, lower than said first potential level, said second activation control circuit includes a first field effect transistor electrically coupled between said second reference node and a first internal node, and having a gate electrically coupled to said first intermediate node, a second field effect transistor electrically coupled between said first internal node and a potential supply node supplying a potential corresponding to said second signal level, and having a gate electrically coupled to said first intermediate node, a third field effect transistor electrically coupled between a second internal node and said potential supply node, and having a gate electrically coupled to said first internal node, a fourth field effect transistor electrically coupled between a third internal node and said potential supply node, and having a gate electrically coupled to said first intermediate node, a latch circuit setting and holding potentials of said second and third internal nodes to respective ones of two potentials corresponding to said first and second signal levels, respectively, in accordance with potentials of said second and third internal nodes, and a signal buffer generating said second control signal, in accordance with a potential of said third internal node.

11. The semiconductor device according to claim 10, wherein said third field effect transistor can form a current path between said second internal node and said potential supply node, when said second potential is input to the gate via said first field effect transistors.

12. The semiconductor device according to claim 10, wherein said second potential is no higher than a potential level of said reference potential signal at a steady state.

13. A semiconductor device supplied with first and second external power-supply potentials respectively from first and second external power-supply, for operating, comprising:

a first external power-supply line supplying said first external power-supply potential;

a second external power-supply line supplying said second external power-supply potential;

a voltage generating circuit converting said first external power-supply potential received from said first external power-supply line into an internal power-supply potential to be supplied to an internal power-supply line;

said voltage generating circuit including a reference potential generating unit receiving said first external power-supply potential from said first external power-supply line, for generating a reference potential signal in accordance with a set potential level of said internal power-supply potential at a first intermediate node, a voltage converting circuit supplying current in accordance with a difference between potential levels of said internal power-supply line and said first intermediate node, from said first external power-supply line to said internal power-supply line, a first current-supply circuit supplying a first operational current to said voltage converting circuit for an activation period of a first control signal, and a first activation control circuit activating said first control signal, during a period from activation of said first external power-supply until a potential level of said internal power-supply line reaches a predetermined level, said first activation control circuit detecting said activation of said first external power-supply, by comparing a potential level of a first reference node to that of said internal power-supply line;

said semiconductor device further comprising:

an internal circuit receiving said internal power-supply potential from said internal power-supply line, for operating; and first, second and third metal interconnections formed on a same metal interconnection layer and respectively electrically coupled to said first reference node, said first intermediate node and said second external power-supply line, said first metal interconnection and one of said second and third metal interconnections are electrically coupled on said metal interconnection layer.

14. The semiconductor device according to claim 13, wherein:

said reference potential generating unit includes a primary reference potential generating circuit receiving said first external power-supply potential from said first external power-supply line to generate a primary reference potential signal for generating said reference potential signal at a second intermediate node, and a reference potential generating circuit charging said first intermediate node in accordance with a difference between potential levels of said second intermediate node and said first intermediate node;

said voltage generating circuit including a second current-supply circuit supplying a second operational current to said reference potential generating circuit, a third current-supply circuit supplying a third operational current larger than said second operational current to said reference potential generating circuit during an activation period of a second control signal, and a second activation control circuit activating said second control signal for a period from activation of said first external power-supply until a potential level of said first intermediate node reaches a predetermined level;

said second activation control circuit detecting said activation of said first external power-supply by comparing a potential level of a second reference node to that of said first intermediate node, said semiconductor device further comprising:

fourth and fifth metal interconnections respectively electrically coupled to said second reference node and said second intermediate node, formed on said same metal interconnection layer, said fourth metal interconnection being electrically connected to one of said third and fifth metal interconnections, in said metal interconnection layer.

15. A semiconductor device, supplied with a first external power-supply potential from a first external power-supply, comprising:

an external power-supply line supplying said first external power-supply potential; and a plurality of voltage generating circuits, receiving said first external power-supply potential from said external power-supply line, for converting into a plurality of internal power-supply potentials;

each of said voltage generating circuits including an internal power-supply line outputting a corresponding one of said plurality of internal power-supply potentials at a first intermediate node, a reference potential generating unit receiving said first external power-supply potential from said external power-supply line, for generating a reference potential signal in accordance with a set potential level of said corresponding one of internal power-supply potentials, a voltage converting circuit supplying current in accordance with a difference between potential levels of said internal power-supply line and said first intermediate node, and a first current-supply circuit supplying a first operational current to said voltage converting circuit, in response to an activation of a first control signal, one of said plurality of voltage generating circuits including a first activation control circuit activating said first control signal, for a period from activation of said first external power-supply until a potential level of said internal power-supply line corresponding to any one of said plurality of voltage generating circuits reaches a predetermined potential level, said first activation control circuit detecting said activation of said first external power-supply by comparing a potential level of a first reference node transmitting a first potential to that of said internal power-supply line corresponding to another one of said plurality of voltage generating circuits, said first reference node being electrically separated from a node affecting a potential level of said reference potential signal;

said semiconductor device further comprising:

a plurality of internal circuits supplied with said plurality of internal power-supply potentials from said plurality of voltage generating circuits, for operation.

16. The semiconductor device according to claim 15, wherein said semiconductor device is further supplied with a second external power-supply potential from a second external power-supply, for operation, and said first reference node is coupled to said second external power-supply potential.

17. The semiconductor device according to claim 15, wherein:

said first control signal includes a first signal level corresponding to an activated state, and a second signal level corresponding to an inactivated state, lower than said first potential level; and said first activation control circuit includes a first field effect transistor electrically coupled between said first reference node and a first internal node, having a gate electrically coupled to said internal power-supply line included in said another one of said plurality of voltage generating circuits, a second field effect transistor electrically coupled between said first internal node and a potential supply node supplying a potential corresponding to said second signal level, having a gate electrically coupled to said internal power-supply line included in said another one of said plurality of voltage generating circuits, a third field effect transistor electrically coupled between a second internal node and said potential supply node, having a gate electrically coupled to said first internal node, a fourth field effect transistor electrically coupled between a third internal node and said potential supply node, having a gate electrically coupled to said internal power-supply line included in said any one of said plurality of voltage generating circuit, a latch circuit setting and holding potentials of said second and third internal nodes to respective ones two potentials corresponding to of said first and second signal levels, respectively, in accordance with potentials of said second and third internal nodes and a signal buffer generating said first control signal in accordance with a potential of said third internal node.

18. The semiconductor device according to claim 15, wherein said reference potential generating unit includes a primary reference potential generating circuit receiving said first external power-supply potential from said external power-supply line, to generate a primary reference potential signal for generating said reference potential signal at a second intermediate node, and a reference potential generating circuit charging said first intermediate node in accordance with a difference between potential levels of said second intermediate node and said first intermediate node, each of said voltage generating circuits including a second current-supply circuit supplying a second operational current to said reference potential generating circuit, and a third current-supply circuit supplying a third operational current larger than said second operational current to said reference potential generating circuit, during an activation period of a second control signal, one of said voltage generating circuit further including a second activation control circuit activating said second control signal for a period from activation of said first external power-supply until a potential level of said first intermediate node corresponding to any one of said plurality of voltage generating circuits reaches a predetermined level, said second activation control circuit detecting said activation of said first external power-supply, by comparing a potential level of a second reference node transmitting a second potential to that of said first intermediate node corresponding to another one of said plurality of voltage generating circuits, said second reference node being separated from a node affecting a potential level at least one of said primary reference potential signal and said reference potential signal.

19. The semiconductor device according to claim 18, wherein said semiconductor device is further supplied with a second external power-supply potential from a second external power-supply, for operating, and said second reference node is coupled to said second external power-supply potential.

20. The semiconductor device according to claim 18, wherein said second control signal has a first signal level corresponding to an activated state and a second signal level corresponding to an inactivated state, lower than said first potential level, said second activation control circuit includes a first field effect transistor electrically coupled between said second reference node and a first internal node, having a gate electrically coupled to said first intermediate node included in said another one of said plurality of voltage generating circuits, a second field effect transistor electrically coupled between said first internal node and a potential supply node supplying a potential corresponding to said second signal level, having a gate electrically coupled to said first intermediate node included in said another one of said plurality of voltage generating circuits, a third field effect transistor electrically coupled between a second internal, node and said potential supply node, having a gate electrically coupled to said first internal node, a fourth field effect transistor electrically coupled between a third internal node and said potential supply node, having a gate electrically coupled to said first intermediate node included said any one of said plurality of voltage generating circuits, a latch circuit setting and holding potentials of said second and third internal nodes to respective ones of two potentials corresponding to said first and second potential levels respectively, in accordance with potentials of said second and third internal nodes, and a signal buffer generating said second control signal, in accordance with a potential of said third internal node.

* * * * *